United States Patent [19]

Sakitani et al.

[11] Patent Number: 4,854,131

[45] Date of Patent: Aug. 8, 1989

[54] VERY LOW TEMPERATURE REFRIGERATOR

[75] Inventors: Katsumi Sakitani; Yoon M. Kang; Shinichiro Shinozaki; Shoichi Taneya; Kazuo Miura; Tadashi Ogura; Satoshi Noguchi, all of Osaka, Japan

[73] Assignee: Daikin Industries, Ltd., Osaka, Japan

[21] Appl. No.: 268,605

[22] Filed: Nov. 7, 1988

Related U.S. Application Data

[63] Continuation-in-part of Ser. No. 50,474, May 18, 1987, abandoned.

[30] Foreign Application Priority Data

May 16, 1986 [JP] Japan ..... 61-113334

[51] Int. Cl.[4] ..... F25B 19/00

[52] U.S. Cl. ..... 62/51.2; 62/296; 248/636; 248/638

[58] Field of Search ..... 62/55.5, 514 R, 269; 417/901; 248/636, 638

[56] References Cited

U.S. PATENT DOCUMENTS

| | | | |
|---|---|---|---|
| 3,609,992 | 10/1971 | Cacheux | 62/514 R |
| 3,742,729 | 7/1973 | Zulliger | 62/514 R |
| 3,894,403 | 7/1975 | Longsworth | 62/514 R |
| 4,233,540 | 9/1980 | Longsworth | 62/514 R |
| 4,363,217 | 12/1982 | Venuti | 62/55.5 |
| 4,501,131 | 2/1985 | Gaskin et al. | 62/514 R |
| 4,539,822 | 9/1985 | Sundquist | 62/55.5 |
| 4,672,202 | 6/1987 | Crossley, Jr. et al. | 62/514 R |

*Primary Examiner*—Ronald C. Capossela

*Attorney, Agent, or Firm*—Wenderoth, Lind & Ponack

[57] ABSTRACT

In cryogenic refrigerator provided with a cryostat having a low temperature level maintaining part for cooling and maintaining a part to be cooled at a very low temperature level and an expander which is fitted in the low temperature level maintaining part of the cryostat and generates cold in the low temperature level maintaining part by expanding refrigerant gas compressed by a compressor, vibration of the working expander is prevented from being transmitted to the part to be cooled by fixing and supporting the part to be cooled to the cryostat, separately from the expander, thereby minimizing the bad influence or vibration on a cryogenic working apparatus which is sensitive to vibration and by integrally supporting the part to be cooled and the expander to the crystat. In this way, the necessity of supporting the part to be cooled and the expander individually is eliminated and installation of the refrigerator is easy.

13 Claims, 6 Drawing Sheets

VERY LOW TEMPERATURE REFRIGERATOR

This application is a continuation-in-part of now abandoned application Ser. No. 050/474, filed 5/18/87.

BACKGROUND OF THE INVENTION

1. Field of the Invention

This invention relates to a cryogenic refrigerator in which a very low temperature level is generated in a cryostat (low temperature tank) and which maintains a cryostat working apparatus in a refrigerated state by expanding refrigerant gas, such as helium gas, and particularly to a measure of reducing vibration in a cryogenic working apparatus in a cryostat which is maintained at a very low temperature level.

2. Description of the Prior Art

As disclosed in U.S. Pat. No. 4,223,540, a helium refrigerator is well known as a very low temperature refrigerator. This helium refrigerator is provided with a precooling refrigerating circuit, whereby a cryogenic maintaining part in a cryostat is radiantly shielded from the outside by expanding high pressure helium gas by an expander, and a J-T circuit whereby compressed helium gas discharged from another compressor is precooled in said precooling refrigerating circuit and such precooled helium gas is then Joule-Thomson expanded at a J-T valve to generate cold in the cryogenic level maintaining part of the cryostat by expanding action at that time.

Another type of a helium refrigerator which is also known is a helium refrigerator which is provided with such an expander as mentioned above but without a J-T circuit and generates cold in a low temperature level maintaining part of a cryostat by expanding helium gas by the expander.

In such a helium refrigerator, a refrigerating part which is arranged in a low temperature level maintaining part of a cryostat and refrigerates an object for cooling is supported at the lower part of a cylinder of an expander.

However, in such helium refrigerators as mentioned above, a G-M cycle (Gilford-MacMahon cycle), a modified Solvay cycle or the like is generally employed as a refrigerating cycle provided by a precooling refrigerating circuit. In this case, it is inevitable that vibration is generated due to a change of pressure (high pressure/-low pressure) in flowing gas at an expander, collision of a displacer with a cylinder, expansion and shrinkage of a cylinder due to change of pressure (high pressure/low pressure), etc. Thus, it was difficult to use such cycles in a system including a photo-detecting sensor to be used in spectrochemical study where micro vibration in the order of $\mu$m must be avoided.

From the above, a construction in which an expander and a part to be cooled are supported individually by a cryostat comes under consideration as a solution to the vibration problem. However, such an individual support construction causes difficulty in the setting up of a refrigerator and the only cooling method which can be employed is one in which the working of an expander is stopped when a cryogenic working apparatus is working, and to refrigerate a part to be cooled by cold heat of such liquid helium. Thus, the field of use of refrigerators is limited.

SUMMARY OF THE INVENTION

The present invention has been made in view of the above-mentioned. An object of the present invention is to accurately reduce the transmission of vibration of an expander to the part to be cooled, without sacrificing the installability of the refrigerator, and thereby increase the range of use of cryogenic refrigerators. The present invention resides in proper means for isolating part to be cooled, which imparts cold to a cryogenic working apparatus such as photodetecting sensor, from an expander which is a source of vibration.

For the above-described purpose, in the cryogenic refrigerator provided with a cryostat having a low temperature level maintaining part for cooling and maintaining the part to be cooled at a very low temperature level and an expander which is fitted in the low temperature level maintaining part of the cryostat and generates a very low temperature level in the low temperature level maintaining part by expanding refrigerant gas compressed by a compressor, the present invention has such a construction that the part to be cooled is separated from an expander and is fixed to and supported by a cryostat. Due to such a construction, coupled with the fact that a cryostat is heavy and is displaced relatively very little by vibration generated in the expander, the transmission of the vibration in the working expander to the part to be cooled is resricted and accordingly a cryogenic working apparatus which is sensitive to vibration is uninfluenced by such vibration and also the supporting of the part to be cooled and the expander separately is not necessary which makes the installation of a refrigerator easy.

According to the present invention, for the cryogenic refrigerator which is so designed that a very low temperature level is generated in a cryostat which keeps cooled a part to be cooled by expanding high pressure refrigerant gas by an expander, the part to be cooled is fixed to and supported by a cryostat separately from an expander and by this arrangement, vibration generated during the operation of the expander is kept from being transmitted to the part to be cooled and accordingly a cryogenic working apparatus, such as a sensor which is sensitive to vibration, can be stably used. Also, since both the expander and the part to be cooled are supported by the cryostat, the installation of the refrigerator is easy and as a result, the range of use of refrigerators can be increased.

BRIEF DESCRIPTION OF THE DRAWING

FIG. 1–FIG. 4 show preferred embodiments of the present invention, in which FIG. 1 is a longitudinal sectional view, showing the inner construction of a cryostat;

FIG. 2 is a cross-sectional view of the cryostat shown in FIG. 1;

FIG. 3 is a schematic diagram of a helium refrigerator; and

FIG. 4 is a characteristic drawing showing the vibration characteristic of a sensor part.

DETAILED DESCRIPTION OF PREFERRED EMBODIMENTS

Preferred embodiments of the present invention are described below with reference to the drawings.

Figure 3:
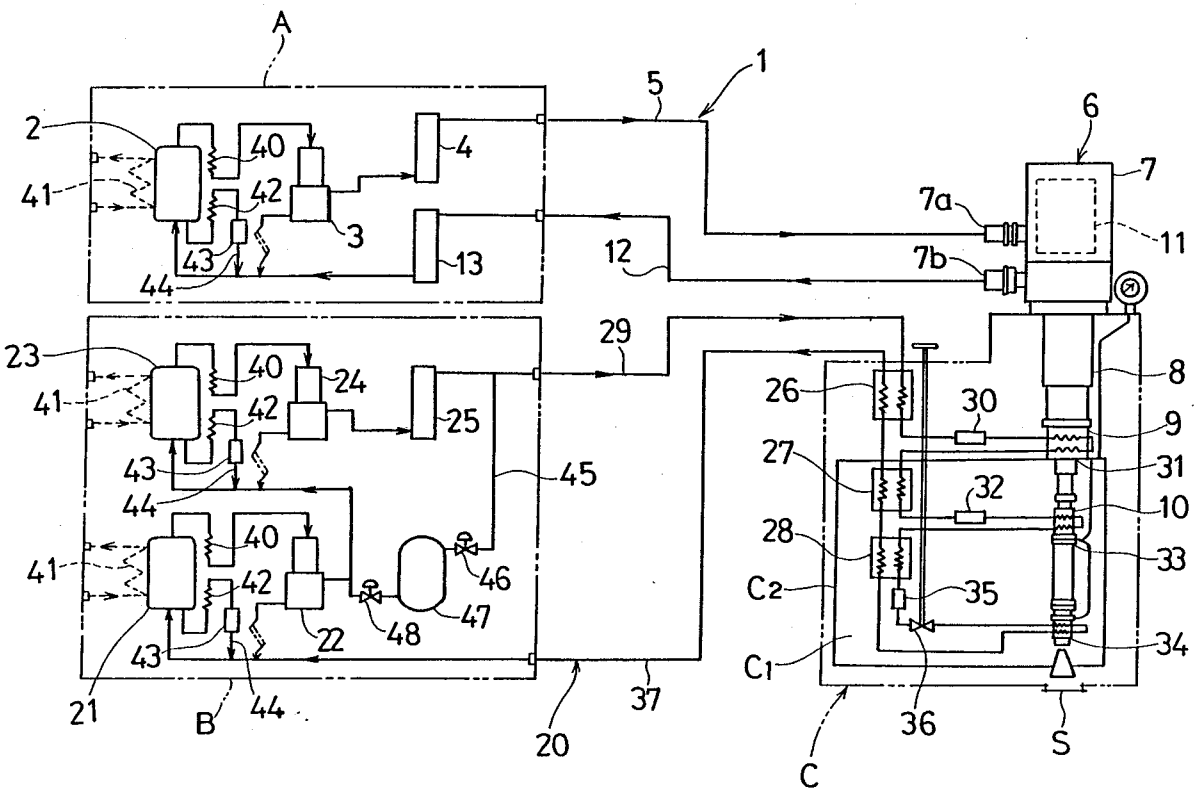

FIG. 3 shows a helium refrigerator having a dual two-stage compression cycle according to the present invention. Symbol C designates a cryostat having a low temperature level maintaining part $C_1$ therein which cools a photo-detecting sensor S having a condenser part for facilitating spectrochemical study as a cryogenic working apparatus which is used at a very low temperature level. Numeral 1 designates a precooling refrigerating circuit having a modified Solvay cycle which compresses and expands helium gas for precooling helium gas in a J-T circuit 20 (to be described next). Numeral 20 designates a J-T circuit which compresses and Joule-Thomson expands helium gas for generating a very low temperature level. The above-mentioned precooling refrigerating circuit 1 and the J-T circuit 20 are arranged in a row, the former extending from a compressor unit for precooling A to the cryostat C and the latter extending from a compressor unit on J-T side B to the cryostat C.

The above-mentioned compressor unit for precooling A is provided with a compressor 2 for precooling which compresses helium gas, an oil separator 3 which separates lubricating oil for the compressor 2 from high pressure helium gas compressed by the compressor 2 and an adsorber 4 which adsorbs and removes water, impure gas, etc. in the helium gas which has passed through the oil separator 3. The adsorber 4 is connected to a high pressure side entrance 7*a* of a casing 7 for an expander 6 fitted to the cryostat C, via high pressure side piping 5.

The expander 6 has the casing 7 disposed outside the cryostat C and a cylinder 8 connected to the lower part of the casing 7. Provided at the outer circumference of the cylinder 8 are a second heat station 10 and a first heat station 9, both disposed in the low temperature level maintaining part $C_1$. Fitted in the casing 7 are a rotary valve (not shown in the drawing) which opens at every rotation to feed helium gas flowing from the high pressure side entrance 7*a* into the cylinder 8 and a valve motor 11 which drives said rotary valve. Although not shown in the drawing, fitted in the cylinder 8 are a slack piston which reciprocates according to the opening and shutting of the rotary valve and a displacer which reciprocates in the cylinder 8 by being engaged with and driven by the slack piston and which Simon expands helium gas. The first station 9 of the cylinder 8 is thermally connected with a radiant shield part $C_2$ which is arranged in such a fashion that it encloses the low temperature level maintaining part $C_1$ in the cryostat C. In this arrangement, high pressure helium gas is expanded in the cylinder by opening the rotary valve of the expander 6 to generate the low temperature state, which is maintained at the first and the second stations 9, 10 in the cylinder 8, and to cool down to a low temperature the radiant shield part $C_2$ which is in thermal contact with the first heat station 9 so as to radiantly shield the low temperature level maintaining part $C_1$ from the outside.

A low pressure side exit 7*b* for discharging low pressure helium after expansion is open to the casing 7 of the expander 6. The low pressure side exit 7*b* is connected to a surge bottle 13 provided at the compressor unit for precooling A, via low pressure side piping 12. The surge bottle 13 is connected to the intake side of the compressor for precooling 2. Low pressure helium gas discharged from the expander 6 is absorbed by the surge bottle 13 and sucked in by the compressor 2. Thus, high pressure helium gas discharged from the compressor 2 for precooling is fed to the expander 6, via the oil separator 3 and the adsorber 4, and due to the adiabatic expansion at the expander 6, the temperature of the heat stations 9, 10 is lowered, whereby the low temperature level maintaining part $C_1$ in the cryostat C is radiantly shielded, coolers 31, 33 (to be described later) at the J-T circuit 20 are cooled, and expanded low pressure helium gas is returned to the compressor 2 for recompression, via the surge bottle 13.

Provided at the J-T side compressor unit B are a low stage compressor 21 for compressing helium gas to a specified pressure, an oil separator 22 for separating and removing lubricating oil for the compressor 21 from high pressure helium gas discharged from the compressor 21, a high stage compressor 23 for compressing high pressure helium gas which has passed through the oil separator to a still higher pressure, an oil separator 24 for separating and removing lubricating oil for the compressor 23 from high pressure helium gas discharged from the compressor 23 and an adsorber 25 for adsorbing and removing impurities in the high pressure helium gas which has passed through the oil separator 24.

Fitted in the cryostat C are first, second and third J-T heat exchangers 26, 27, 28 for facilitating heat exchange between helium gas passing through the primary side and the secondary side. Of these J-T heat exchangers 26, 27, 28, the second and the third J-T heat exchangers 27, 28 are arranged in the radiant shield part $C_2$ of the cryostat C. The primary side of the first J-T heat exchanger 26 is connected to the adsorber 25 of the J-T side compressor unit B, via the high pressure side piping 29. The primary sides of the first and the second J-T heat exchangers 26, 27 are connected to each other via an adsorber 30 and a first precooler 31 disposed at the outer circumference of the first station 9 of the expander 6. The primary sides of the second and the third J-T heat exchangers 27, 28 are connected to each other via an adsorber 32 and a second precooler 33 arranged at the outer circumference of the second heat station 10. The primary side of the third J-T heat exchanger 28 is connected to a refrigeration stage 34, which is supported at the lower end of the cylinder 8 of the expander 6 and is located in the low temperature level maintaining part $C_1$, via an adsorber 35 and a J-T valve 36 which Joule-Thomson expands high pressure helium gas. The refrigeration stage 34 is connected to the secondary side of the first J-T heat exchanger 26 via the secondary sides of the third and the second J-T heat exchangers 28, 27. The secondary side of the first J-T heat exchanger 26 is connected to the intake side of the low stage compressor 21 in the J-T side compressor unit B via low pressure side piping 37. In this arrangement, helium gas is compressed to have a high pressure by two compressors 21, 23 connected in two-stage series and is fed to the cryostat C side. The high pressure helium gas undergoes heat exchange at the first, second and third J-T heat exchangers 26, 27, 28, with low temperature/low pressure helium gas returning to the J-T side compressor unit B, further undergoes heat exchange at the first and the second coolers 31, 33 with the first and the second stations 9, 10 and is cooled, is Joule-Thomson expanded by a J-T valve 36 to a pressure and temperature of 1 atm and about 4 K. at the refrigeration stage 34. Then, the helium which has been made to have a low pressure is drawn into the low stage compressor 21 of the J-T side compressor unit B, passing through the secondary sides of the first, second and third J-T heat exchangers 26, 27, 28, for re-compression.

The compressor 2 of the compressor unit for precooling A and two compressors 21, 23 of the J-T side compressor unit B, together with surrounding apparatuses, are of similar construction. In the drawing, numeral 40 designates discharge gas coils arranged along a flow path from the discharge side of compressors 2, 21, 23 to the oil separators 3, 22, 24. These discharge gas coils 40 are wound around the upper half of the outer circumference of the casing of each compressor 2, 21, 23. Wound around the entire outer circumference of the casing of each compressor 2, 21, 23 and along the discharge gas coils 40 are cooling water coils 41 in which cooling water runs. Due to the cooling water which runs in the cooling water coils 41, high temperature/high pressure helium gas which was discharged from the compressors 2, 21, 23 and is flowing in the discharge gas coils 40 is cooled down.

Numeral 42 designates oil coils which are wound around along the cooling water coils 41, the lower half of the outer circumferential surface of the casing of each compressor 2, 21, 23. The upstream ends of the oil coils 42 are connected to the oil tank at the inner bottom part of the casing of each compressor 2, 21, 23 and the downstream ends are connected to the intake side of each compressor 2, 21, 23 via orifices 43 and injection pipes 44. Lubricating oil in the casing to be discharged, together with helium gas, from each compressor 2, 21, 23 is fed to the oil coils 42 and is cooled down with cooling water in the cooling water coils 41 and then is injected in the helium gas by the orifices 43 of the injection pipes 44.

Numeral 45 designates a connecting pipe which connects the discharge side of the oil separator 22 of the J-T side compressor unit B with the discharge side of the adsorber 25. Arranged along this connecting pipe are a high pressure control valve 46 which decompresses the pressure of helium gas discharged from the compressor unit B, a gas ballast tank 47 to which high pressure helium gas flows from the high pressure control valve 46 and an intermediate pressure control valve 48 which feeds high pressure helium gas in the tank 47 to the discharge side of the oil separator 22 and controls the discharging pressure of the low stage compressor 21.

Figure 1:
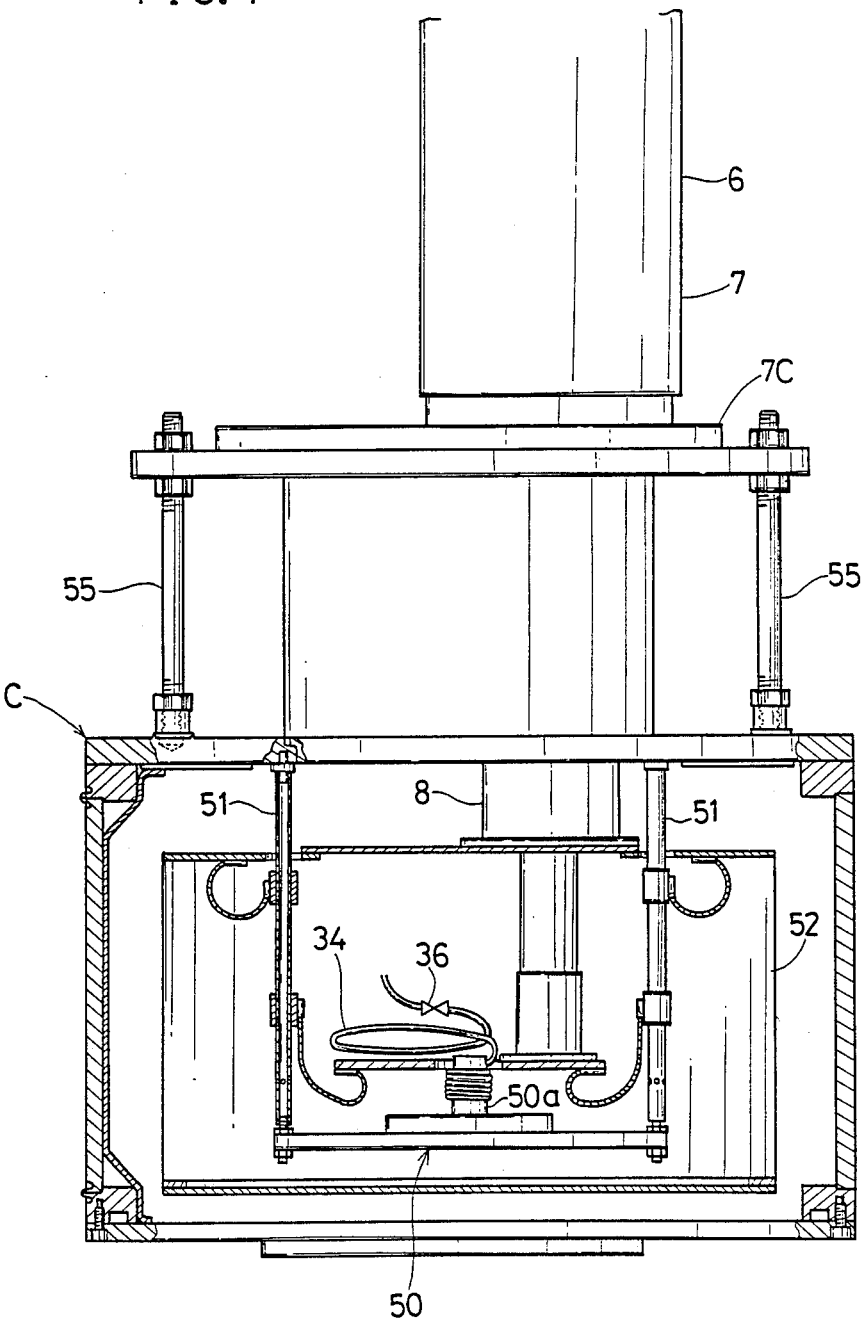

The characterizing features of the present invention are shown in FIG. 1, and reside in that the low temperature level maintaining part of the cryostat $C_1$ has therein a cooling stage 50 supporting the photo-detecting sensor S. This cooling stage 50 is suspended from the upper wall in the low temperature level maintaining part $C_1$ by the perpendicular supports 51, 51 . . . at trisected positions of its outer circumference. Therefore, in this construction, the cooling stage 50 is fixed to and supported by the cryostat C so as to be separated from the expander 6.

Also arranged in the low temperature level maintaining part $C_1$ is a housing member 52 having a closed cylindrical shape housing the cooling stage 50, J-T heat exchangers 26, 27, 28 and their surrounding apparatuses. The housing member 52 is connected to and supported by the cylinder 8 of the expander 6 at its upper wall part.

The refrigeration stage 34 has a coil shape and is wound around a cold receiving part $S_1$ of the sensor S. A flexible coil of piping formed in an involute having a large radius extends between the J-T valve 36 and the refrigeration stage 34. Due to the elasticity of this piping having a coil shape, the cooling stage 50 is elastically connected to the J-T heat exchanger 28.

Figure 2:
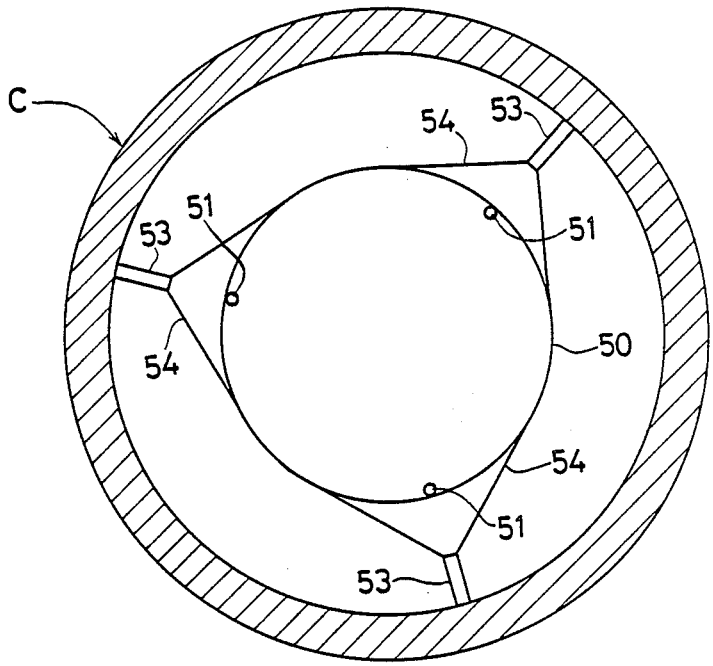

As shown in FIG. 2, a support bracket 53 protrudes from the inner circumferential wall of the cryostat C, on the extension of a line connecting the center of the cooling stage 50 and the perpendicular support 51. Each support bracket 53 is connected with a wire member 54 having high rigidity and a low thermal conductivity. Each wire member 54 is kept in a state of tension and both ends thereof are joined, by welding or other means, to the outer circumferential edge of the cooling stage 50 on both sides of the perpendicular support 51. By these wire members 54, 54 . . . the cooling stage 50 is supported by spring force exerted thereon from a diametrical direction and from a circumferential direction.

In FIG. 1, numeral 55 designate support rods which support the expander 6 on the cryostat C via a flange part 7C at the lower end of the casing 7. These support rods may be dispensed with, if the expander can be fixed firmly at the central part.

The operation of the helium refrigerator according to the above described embodiment is made below.

When the compressor 2 of the precooling refrigerating circuit 1 and two compressors 21, 23 at the J-T circuit 20 are started and the refrigerator is in a normal operating state, high pressure helium gas fed from the compressor 2 is expanded by the expander 6 on the cryostat C side and due to this expansion of the gas, the temperature of each heat station 9, 10 of the cylinder 8 and the radiant shield part $C_2$, which makes thermal contact with the first heat station 9, lowers and thus the low temperature level maintaining part $C_1$ in the cryostat C is radiantly shielded from to the outside.

At the same time, helium gas which is returning from the cryostat C via the J-T circuit 20 is drawn into and compressed by the low stage compressor 21 and is cooled down to a normal temperature of 300 K. with cooling water in the cooling water coil 41. Oil in this cooled down helium is separated by the oil separator 22 and then the helium is drawn into and compressed by the high stage compressor 23. Discharged gas from the compressor 23 is cooled down to the normal temperature of 300 K. with cooling water in the cooling water 41 extending around the compressor 23 and after its oil content is separated by the oil separator 24, impurities are adsorbed by the adsorber 25 and clean high pressure helium gas thus obtained is fed to the cryostat C.

High pressure helium gas fed to the cryostat C side enters the primary side of the first J-T heat exchanger 26 undergoes heat exchange with low pressure helium gas on the secondary side which is returned to the J-T side compressor unit B, is cooled down to about 70 K. from the normal temperature 300 K. and enters the first precooler 31 at the outer circumference of the first heat station 9 of the expander 6 which has been cooled down to 50–60 K. and there it is cooled down to about 55 K. This cooled down gas enters the primary side of the second J-T heat exchanger 27 and is cooled down to about 20 K. by undergoing heat exchange with low pressure helium gas on the secondary side which is returned to the J-T side compressor unit B and then enters the second precooler 33 at the outer circumference of the second heat station of the expander 6 which has been cooled down to 15–20 K. and there it is cooled down to about 15 K. Then, the gas enters the primary side of the third J-T heat exchanger 28 and is cooled down to about 5 K. by undergoing heat exchange with low pressure helium gas on the secondary side which returns to the J-T side compressor unit B and reaches the J-T valve 36. High pressure helium gas is throttled by the J-T valve 36 and Joule-Thomson expands into a gas/liquid mixed state (1 atm, 4.2 K.) and is fed to the refrigeration stage 34. At refrigeration stage 34, the latent heat of the evaporation of liquid of the helium in the gas/liquid mixed state is utilized for cooling the photo-detecting sensor S as a substance to be cooled and also for liquefaction and re-condensation of other helium gas.

Then, low pressure helium gas which returns from the refrigeration stage 34 to the secondary side of the third J-T heat exchanger 26 turns into saturated gas at about 4.2 K., cools high pressure helium gas on the primary side in the second and the first J-T heat exchangers 27, 26, rises in temperature to about 300 K. and returns to the J-T side compressor unit B. Thereafter, a similar cycle is repeated and the refrigerating operation is carried out.

In this case, since the cooling stage 50 is separated from the cylinder 8 of the expander 6, is supported by the cryostat C through the perpendicular supports 51, 51 . . . at trisected positions of its outer circumferential edge, and is isolated from vibration in J-T heat exchanger 28, etc. on the J-T circuit 20 side due to the elasticity of flexible piping connected to refrigeration stage 34, vibration generated by the expander 6 is not transmitted to the cooling stage 50 and the photo-detecting sensor S which receives cold from the cooling stage is entirely free from vibration.

Since the cooling stage 50 is urged outward in three diametrical directions by the wire members 54, 54 . . . , in relation to the inner circumferential wall of the cryostat C, rolling thereof along a horizontal plane or revolution thereof about its central part can be reduced effectively and accordingly vibration imparted to the photo-detecting sensor S can be prevented more accurately.

Since the expander 6 and the cooling stage 50 are supported on the cryostat C in an anti-vibration state, it is not necessary to support the expander 6 and the cooling stage 50 individually on the cryostat C for reducing vibration imparted to the photo-detecting sensor S, and therefore, installation of a refrigerator can be done easily and the range of use of refrigerators can be increased.

Figure 7:
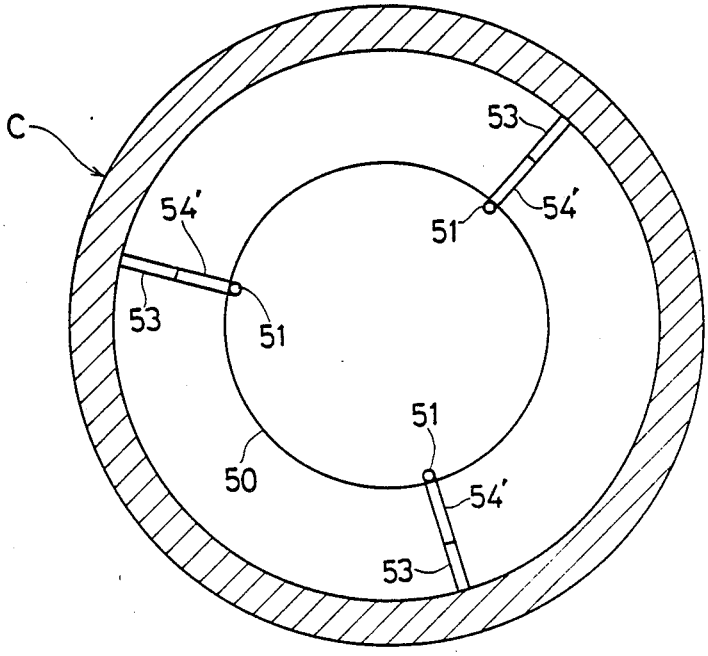
FIG. 7 shows a conventional example corresponding to FIG. 4.
Figure 4:
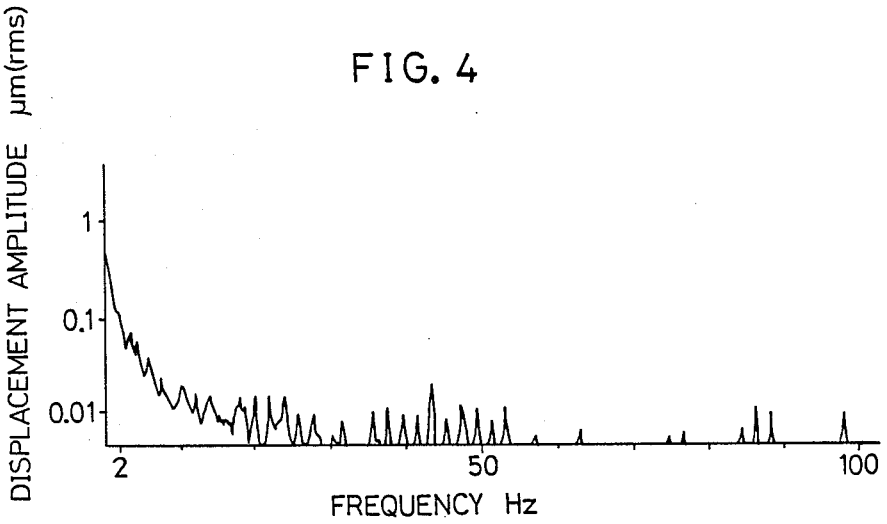
Figure 8:
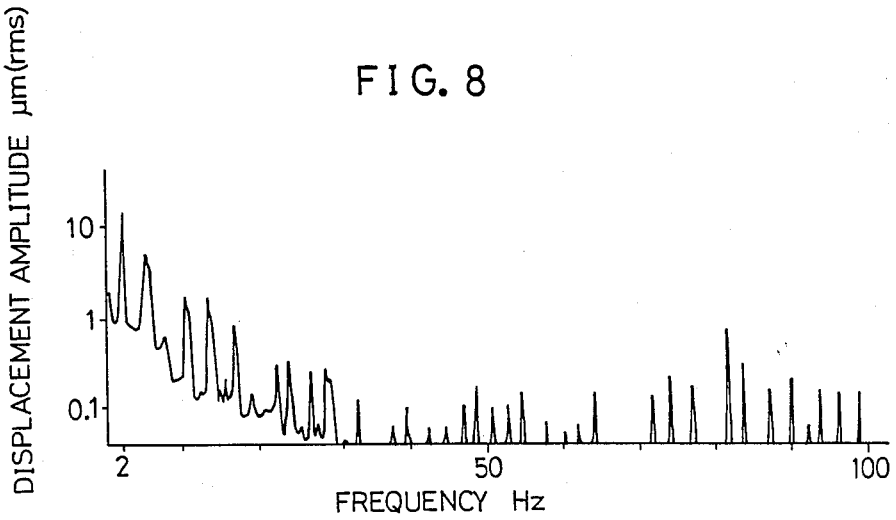

In the above described embodiment, the vibration characteristic of the sensor part was measured and the frequency characteristic as shown in FIG. 4 was obtained. The frequency characteristic of a conventional example is shown in FIG. 7. A comparison of both reveals that the present invention exhibits a better anti-vibration effect than does the conventional example.

Since the expander 6 is installed at the cryostat C which supports the cooling stage 50, it is possible that vibration of the expander 6 is transmitted indirectly to the cooling stage 50 via the cyrostat C. However, since the cryostat C is heavy in weight and is installed at the foundation part of a building, the quantity of transmitted vibration is so microscopic that it can be disregarded and no practical problem is raised.

Figure 5:
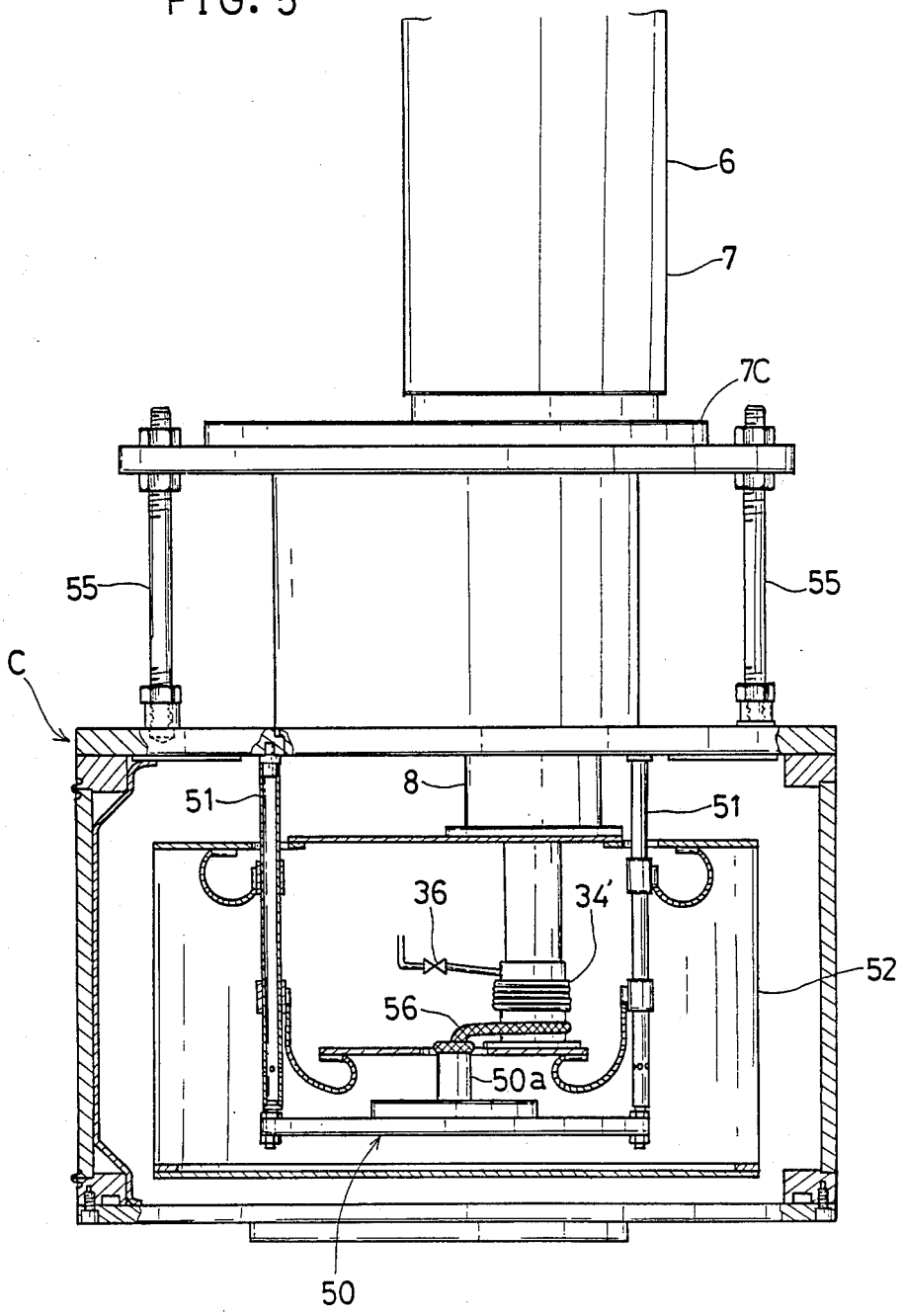
FIG. 5 shows another embodiment of a cooling stage as it is fixed to and supported by the cryostat and correspond to FIG. 1.
Figure 6:
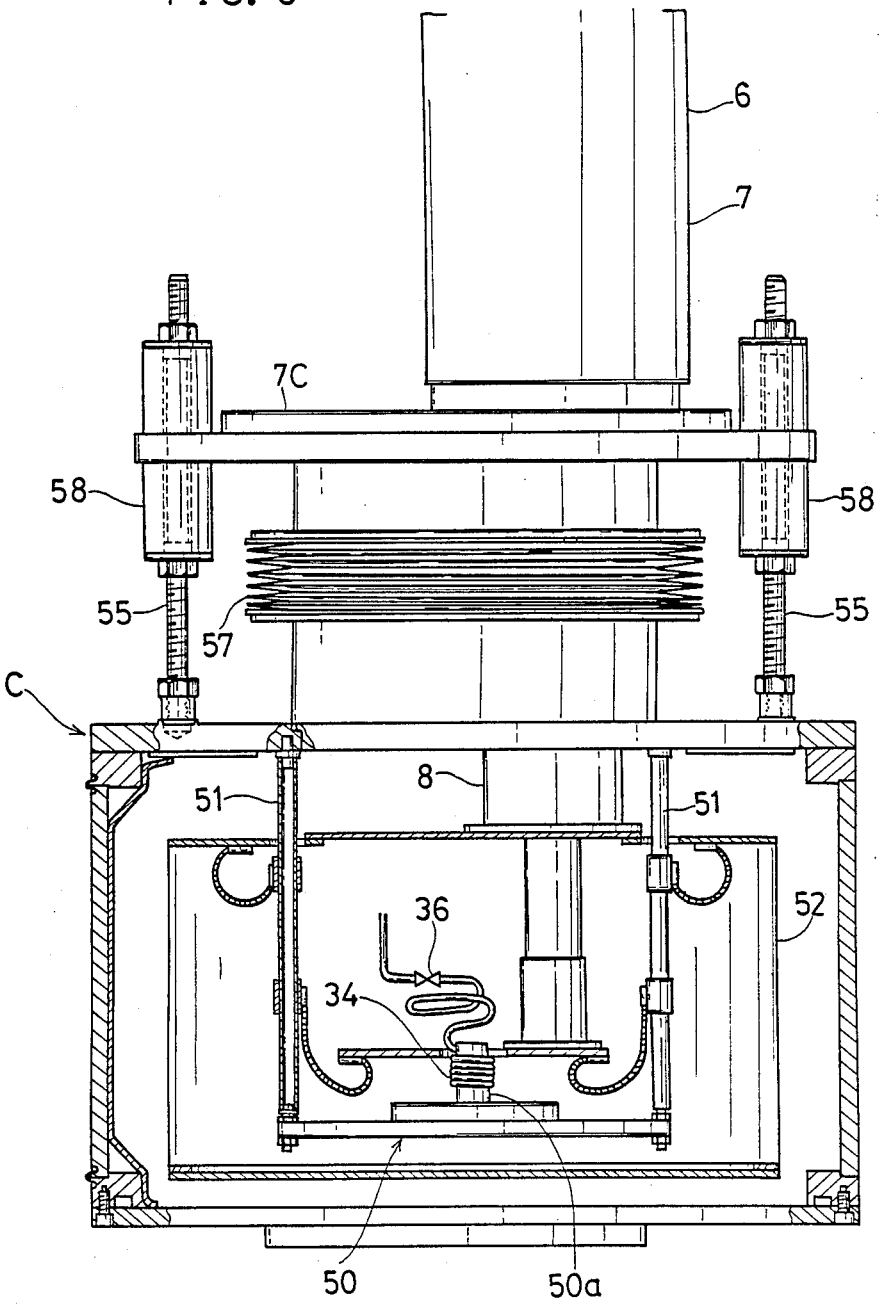
FIG. 6 shows a modified embodiment of the rolling preventive construction of the cooling stage and corresponds to FIG. 2.

The present invention is not limited to the above-described embodiment but includes other embodiments such as that shown in FIGS. 5 and 6.

In the embodiment shown in FIG. 5, an anti-vibration bellows for isolating vibration and for vacuum isolation is interposed between the expander 6 and the cryostat C. Also, each support rod 55 for supporting the expander 6 on the cryostat C is equipped with an anti-vibration rubber element 58 and due to the elasticity of this anti-vibration rubber element 58, vibration of the expander 6 is prevented from being transmitted to the cryostat C.

In this embodiment, therefore, since the expander 6 is supported on the cryostat C through the anti-vibration bellows 57 and each anti-vibration rubber element 58, the specific number of vibrations of the expander 6 and the anti-vibration rubber elements 58 can be set at about 20 Hz, for example, and vibration of the expander 6, especially more than 30 Hz, can be absorbed effectively.

FIG. 6 shows an embodiment which is designed to prevent rolling, etc. of the cooling stage 50 by supporting it on the inner circumferential wall of the cryostat C. The cooling stage 50 is supported only in the diametrical direction by stretching the wire member 54' between the support bracket 53 fitted to the inner circumferential wall of the cryostat C and each perpendicular support 51. In this case, rolling of the cooling stage 50 can be prevented effectively but no noticeable effect is made on the vibration in a rotary direction. Therefore, the embodiment shown in FIG. 2 is preferable.

The present invention is applicable not only to the helium refrigerator having a compression cycle as in the above-described embodiments but also is applicable to the helium refrigerator which is designed to generate a very low temperature level in the cryostat only the expander, omitting the J-T circuit. Furthermore, it can be applied to a very low temperature refrigerator using refrigerant other than helium.

What is claimed is:

1. A cryogenic refrigerator for maintaining an object to be cooled at a cryogenic level, said refrigerator comprising:

a cryostat in which the cryogenic level is established to cool the object;

support means within said cryostat for supporting the object to be cooled in a state generally isolated from vibrations imparted to said cryostat;

a compressor for compressing refrigerant gas, and an expander supported by said cryostat and operatively connected to said compressor for expanding the gas compressed by said compressor thereby lowering the temperature of the refrigerant gas, said expander including heat stations disposed within said cryostat and which are maintained at respective lowered temperatures of the refrigerant gas;

a J-T circuit in a heat exchange relationship with the heat stations of said expander for undergoing heat exchange therewith to precool refrigerant gas in the J-T circuit, a J-T valve operatively connected in the circuit downstream from the location therein at which the heat exchange with said heat stations occurs for Joule-Thomson expanding the precooled refrigerant gas into a gas/liquid state, a refrigeration stage operatively connected in the circuit downstream of the J-T valve and in which the liquid of the refrigerant gas existing in a gas/liquid state after the expansion thereof by said J-T valve evaporates to generate the cryogenic level at said refrigeration stage, and flexible piping connecting said J-T valve and said refrigeration stage in the circuit.

2. A cryogenic refrigerator as claimed in claim 1, wherein said piping comprises a coil.

3. A cryogenic refrigerator as claimed in claim 2, wherein said support means includes a cooling stage and a plurality of supports suspending said cooling stage from said cryostat.

4. A cryogenic refrigerator as claimed in claim 2, wherein said piping comprises a coil extending from said J-T valve to said refrigeration stage.

5. A cryogenic refrigerator as claimed in claim 1, and further comprising means connected between said expander and said cryostat for resiliently supporting said expander on said cryostat.

6. A cryogenic refrigerator as claimed in claim 1, wherein said support means includes a cooling stage and a plurality of supports suspending said cooling stage from said cryostat.

7. A cryogenic refrigerator as claimed in claim 1, wherein said cryostat comprises a side wall, and said support means includes a cooling stage, and a plurality of highly rigid wire members having low thermal conductivity extending between the side wall of said cryostat and said cooling stage.

8. A cryogenic refrigerator as claimed in claim 1, wherein said wire members each have first and second ends connected to said cooling stage at circumferentially spaced apart locations thereon and a central portion connected to the sidewall of said cryostat.

9. A cryogenic refrigerator as claimed in claim 1, wherein said wire members each have a first end portion connected to the side wall of said cryostat and a second end portion connected to said stage.

10. A cryogenic refrigerator as claimed in claim 1, and further comprising means connected between said expander and said cryostat for resiliently supporting said expander on said cryostat.

11. A cryogenic refrigerator as claimed in claim 1, wherein said heat stations consist of two heat stations, and said expander maintains said heat stations at respective cryogenic temperatures of 50°-60° K. and 15°-20° K.

12. A cryogenic refrigerator as claimed in claim 1, wherein said J-T circuit generates a temperature of 4.2° K. at said refrigeration stage.

13. A cryogenic refrigerator as claimed in claim 1, wherein said compressor and said expander constitute a precooling refrigerating circuit, and said precooling refrigerating circuit operates in one of a Gifford-Mcmahon cycle and a modified Solvay cycle.

* * * * *